United States Patent [19]

Patton

[11] 4,275,817

[45] Jun. 30, 1981

[54] SAFETY CLOSURE AND CONTAINER COMBINATION

[75] Inventor: John S. Patton, Richmond, Va.

[73] Assignee: Ethyl Corporation, Baton Rouge, La.

[21] Appl. No.: 83,978

[22] Filed: Oct. 11, 1979

[51] Int. Cl.[3] ..... B65D 55/02

[52] U.S. Cl. ..... 215/217; 215/222; 215/330

[58] Field of Search ..... 215/217, 222, 223, 329, 215/330; 220/293, 295, 296

[56] References Cited

U.S. PATENT DOCUMENTS

| | | | |
|---|---|---|---|
| 2,776,066 | 1/1957 | Thornton | 215/217 |
| 3,610,454 | 10/1971 | Mallick | 215/330 X |

*Primary Examiner*—George T. Hall

*Attorney, Agent, or Firm*—Charles L. Lovercheck

[57] ABSTRACT

A safety closure and container combination is disclosed. The container and closure each have mating lugs which cooperate with each other to move the closure toward the container when rotated in a first direction and to move the closure away from the container when moved in a second direction. Cooperating stop surfaces are provided on the closure and container which engage when the closure is rotated in a direction to move it away from the container so that it is necessary to move the closure toward the container to allow the stop surfaces to move past each other thereby allowing the closure to be removed from the container.

8 Claims, 5 Drawing Figures

SAFETY CLOSURE AND CONTAINER COMBINATION

GENERAL STATEMENT OF THE INVENTION

A closure liner made of resilient material is provided for sealing engagement the end of the container neck and for allowing movement of the closure toward the container. The resilient liner urges the cap away from the container and urges the stops into the spaces between the lugs. The stops are so situated that the closure cannot be removed from the can without first moving it toward the container to move the stop out of interferring position with the lugs on the container.

REFERENCE TO PRIOR ART

U.S. Pat. No. 2,776,066 discloses a closure for containers having screw threads extending around the neck of the container a substantial distance and the skirt of the closure with interruptions for receiving the corresponding thread portions of the closure. Obstructions to the removal of the closure is caused by mating registrations on one element with projections on the other element.

U.S. Pat. No. 4,032,028 discloses a safety closure for a container with a threaded neck and an internally threaded closure. The threads on the neck and on the closure are so proportioned that the closure is axially slidable onto the container at one position.

U.S. Pat. No. 4,139,112 shows a safety closure and container with at least three lugs equiangularly spaced around the closure for engaging corresponding shoulders on the container's thread to prevent removal.

Applicant has provided spaced lugs on the closure to engage spaced lugs on the container and a stop at an end of each of the lugs on the container.

OBJECTS OF THE INVENTION

It is an object of the invention to provide an improved safety container and closure which avoids various limitations and disadvantages of prior related structures.

Another object of the invention is to provide a safety closure and container that is simple in construction, economical to manufacture and simple and efficient to use.

Another object of the invention is to provide a safety closure and container which utilizes a simple stop arrangement in combination with the cam surfaces on the closure and container.

With the above and other objects in view, the present invention consists of the combination and arrangement of parts hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
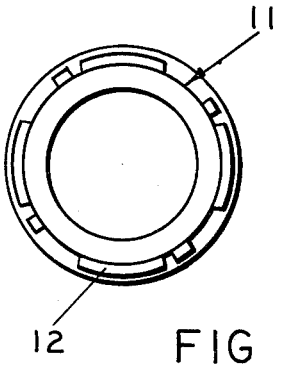
FIG. 1 is a top view of a container according to the invention.
Figure 4:
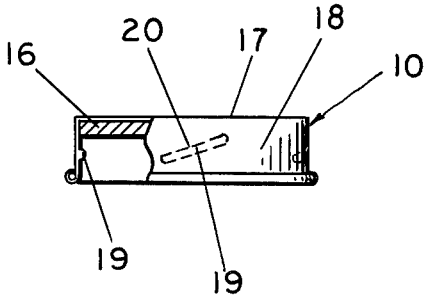
FIG. 4 is a view partly in cross-section of the closure.
Figure 2:
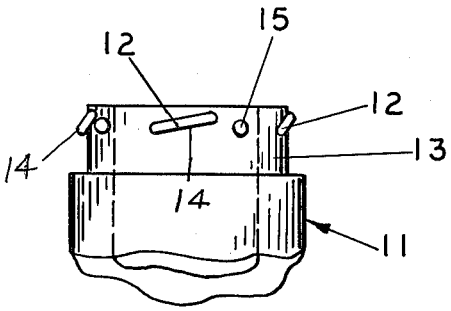
FIG. 2 is a partial side view of the container shown in FIG. 1.

Now with more particular reference to the drawings, I show a safety container closure. In the embodiment of the invention shown in FIGS. 1, 2, 3 and 4 the closure is indicated generally at 10 and the container at 11. The container 11 has a neck 13 and the neck has circumferentially spaced inclined lugs 12 supported on it. The lugs 12 have downwardly facing ramp surfaces 14 that are generally parallel to each other. The stops 15 are fixed to the neck 13 of the container and the stops extend below the lugs 12. The closure 10 has inwardly facing lugs 19 that have upwardly facing ramp surfaces 20 which slide along the downwardly facing ramp surfaces 14 on the lugs 12.

Thus, when the closure 10 is placed on the container and downward force is exerted on it, the resilient liner 16 will be deformed by the rim of the container and the lugs 19 pass under the stops 15 and below the lugs 12 bringing the upwardly facing ramp surfaces 20 into engagement with the downwardly facing ramp surfaces 14. Then as the closure continues to rotate, the cam surfaces 20 will slide down the surfaces 14 causing the closure to seal on the rim of the container.

To remove the cap closure, it is rotated in a counterclockwise direction until the ramps 10 engage the stops 15. Then the operator must push the cap toward the container and rotate it further counterclockwise to bring the ramps 20 below the stops 15.

Stops 15 make it impossible to remove the cap without pushing it toward the container while rotating it.

Figure 5:
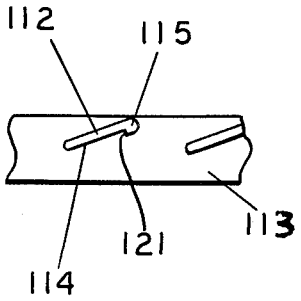
FIG. 5 is a view of another embodiment of the closure shown in FIG. 4.
Figure 3:
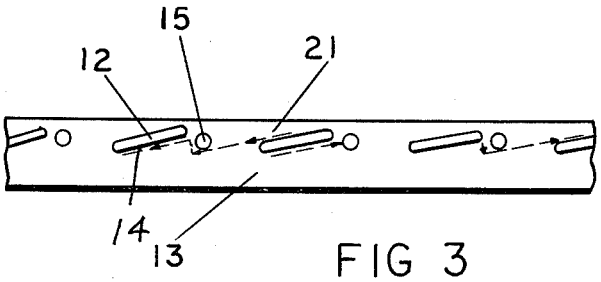
FIG. 3 is a view of a side development of the finish on the container shown in FIG. 1.

In the embodiment of the invention shown in FIG. 5, the container 111 has the neck 113 with lugs 112 thereon. The lugs 112 have stops 115 integral with the lugs 112 and the stops have a stop surface 121 thereon. The lower ramp surfaces 114 of the lugs 112 are in the form of cam surfaces similar to the corresponding surfaces in the embodiment of FIGS. 1, 2 and 3.

In either embodiment, the removal of the closure by a child would be impeded. The child would have to know that it was necessary to push the closure toward the container when the lugs engaged the stops in order for the lugs to pass the stops. This feature would frustrate most children and they would not be subjected to the dangers of the contents of the container. The stops could be on the closure instead of on the container.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination, a safety closure and a container, said container having a neck comprising a first rim terminating in a first open end, spaced relatively rigid first lugs fixed to said first rim, said first lugs each having a first end and a second end and a generally straight relatively flat first ramp surface on the side of said first lugs remote from said first open end and a second ramp surface on the side thereof opposite said first surface, said first lugs being inclined from said first end toward said second end and toward said first open end, said closure having a second rim having a closed end and a second open end adapted to receive said first rim of said container, a resilient liner in said closure engaging said closed end, spaced relatively rigid second lugs fixed to said second rim, said second lugs each having a first end and a second end and a generally straight relatively flat third ramp surface inclined from said first end toward said second end and toward said second open end of said rim on the sides of each said second lug remote from said second open end and a fourth ramp surface on the side of each of said second lugs opposite said third ramp surface on the side thereof remote from said second open end, stops fixed relative to said first lugs and adjacent said first end thereof and on the side of a line passing through said first ramp surface from said first end to said second end of said first lugs, remote from said first open end, and above a line passing through the third ramp surface, whereby, said closure and said container may be telescoped with one another bringing said fourth ramp surfaces into engagement with said second ramp surfaces and upon a relative rotation of said closure and said container in a first direction moving said second lugs past said stop thereby compressing said liner and bringing said third ramp surfaces into engagement with said first ramp surfaces, and bringing said second ends of said second lugs into engagement with said stops holding said closure and said container against relative rotation in a second direction, and upon movement of said closure toward said container compressing said liner moving said second end of said second lugs back past said stops allowing said closure and container to be rotated relative to one another in said second direction removing said closure from said container.

2. The combination recited in claim 1 wherein said first lugs are integral with said stops.

3. The combination recited in claim 1 wherein said first lugs are substantially equal in length to said second lugs to said rim.

4. The combination recited in claim 1 wherein said first lugs are spaced from said stops.

5. The combination recited in claim 1 wherein said first lugs are on said container.

6. The combination recited in claim 5 wherein said stops are on said container.

7. The combination recited in claim 6 wherein said stops are in the form of generally cylindrical members extending axially from said neck.

8. The combination recited in claim 7 wherein said second lugs are spaced from each other a distance substantially equal to the length of each said second lug plus the distance for each said second lug to the side of said stop remote from said second lug.

* * * * *

UNITED STATES PATENT AND TRADEMARK OFFICE

CERTIFICATE OF CORRECTION

PATENT NO. : 4,275,817

DATED : June 30, 1981

INVENTOR(S) : John S. Patton

It is certified that error appears in the above—identified patent and that said Letters Patent is hereby corrected as shown below:

Column 2, line 30 reads, "ramps 10", should read -- lugs 19 --.

Signed and Sealed this

*First* Day of *June 1982*

[SEAL]

*Attest:*

GERALD J. MOSSINGHOFF

*Attesting Officer*

*Commissioner of Patents and Trademarks*